US010537917B2

(12) United States Patent
Park

(10) Patent No.: US 10,537,917 B2
(45) Date of Patent: Jan. 21, 2020

(54) PROPULSION APPARATUS USING SOUND RADIATION FORCE AND CONTROL METHOD THEREFOR

(71) Applicant: Industry-University Cooperation Foundation Hanyang University, Seoul (KR)

(72) Inventor: Kwan Kyu Park, Seoul (KR)

(73) Assignee: Industry-University Cooperation Foundation Hanyang University, Seoul (KR)

( * ) Notice: Subject to any disclaimer, the term of this patent is extended or adjusted under 35 U.S.C. 154(b) by 302 days.

(21) Appl. No.: 15/521,472

(22) PCT Filed: Oct. 23, 2015

(86) PCT No.: PCT/KR2015/011262
§ 371 (c)(1),
(2) Date: Apr. 24, 2017

(87) PCT Pub. No.: WO2016/064239
PCT Pub. Date: Apr. 28, 2016

(65) Prior Publication Data

US 2017/0333948 A1 Nov. 23, 2017

(30) Foreign Application Priority Data

Oct. 23, 2014 (KR) ..... 10-2014-0144477

(51) Int. Cl.
*B06B 3/04* (2006.01)
*B06B 1/02* (2006.01)
(Continued)

(52) U.S. Cl.
CPC ..... *B06B 3/04* (2013.01); *B06B 1/02* (2013.01); *F03H 99/00* (2013.01); *A63H 29/00* (2013.01)

(58) Field of Classification Search
CPC .. B06B 3/04; B06B 1/02; F03H 99/00; A63H 29/00
See application file for complete search history.

(56) References Cited

U.S. PATENT DOCUMENTS 9,726,114 B2 * 8/2017 Wang ..... F03G 7/005
2013/0224018 A1 8/2013 Kinzie et al.

FOREIGN PATENT DOCUMENTS

JP 2004-305510 A 11/2004
JP 2006-319404 A 11/2006
(Continued)

OTHER PUBLICATIONS

International Search Report of PCT/KR2015/011262 dated Jan. 20, 2016.

*Primary Examiner* — Steven M Sutherland
(74) *Attorney, Agent, or Firm* — Sughrue Mion, PLLC

(57) ABSTRACT

A propulsion apparatus using sound radiation force according to an exemplary embodiment of the present invention includes: an ultrasound generation unit which is installed at one side of an object to be operated, generates ultrasound, and provides propulsive force to the object to be operated by using sound radiation force of the ultrasound; and an ultrasound control unit which is coupled to one side of the ultrasound generation unit, and increases propulsive force to be provided to the object to be operated by controlling intensity of the ultrasound generated by the ultrasound generation unit.

9 Claims, 6 Drawing Sheets
(3 of 6 Drawing Sheet(s) Filed in Color)

(51) Int. Cl.
*F03H 99/00* (2009.01)
*A63H 29/00* (2006.01)

(56) References Cited

FOREIGN PATENT DOCUMENTS

| | | | |
|---|---|---|---|
| JP | 2010-096186 | A | 4/2010 |
| JP | 10-2010-0069904 | A | 6/2010 |

* cited by examiner

[Fig. 1]
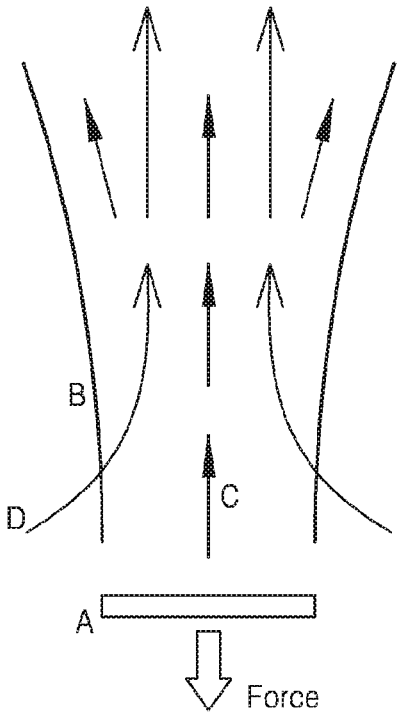
[Fig. 2]
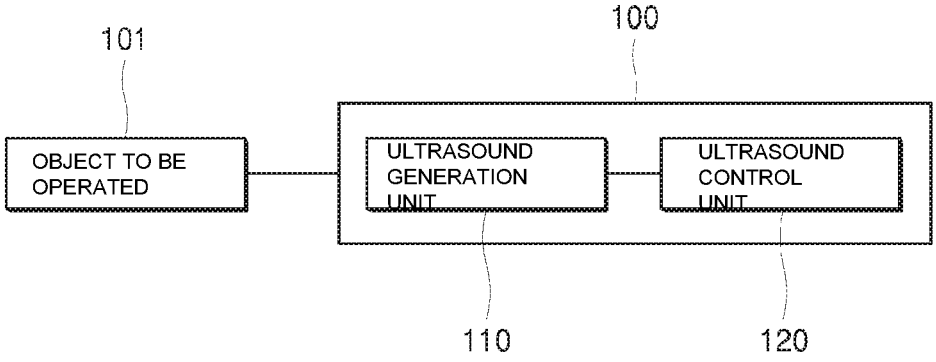

[Fig. 3]
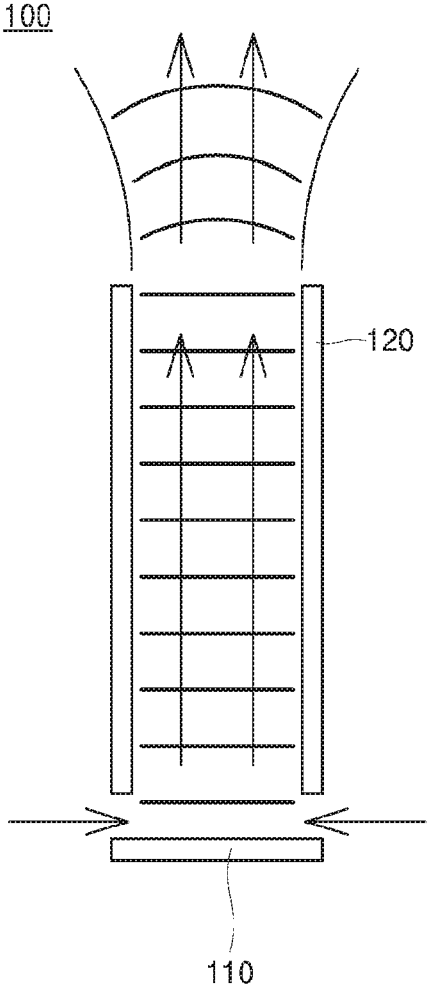

[Fig. 4]
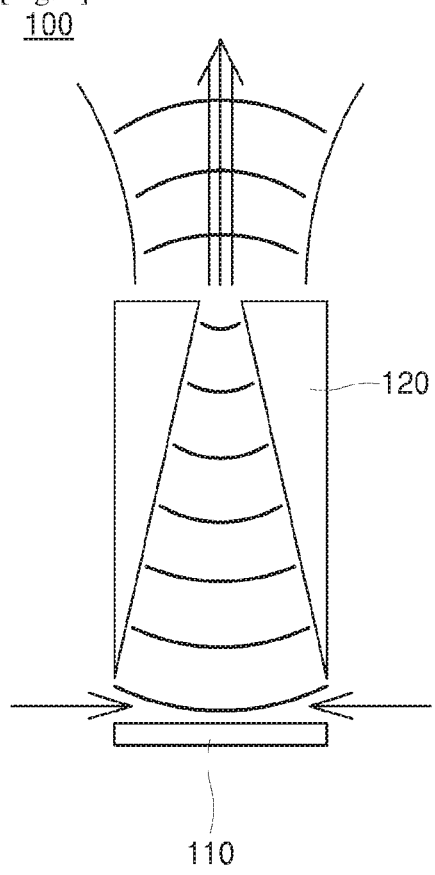

【FIG. 5】
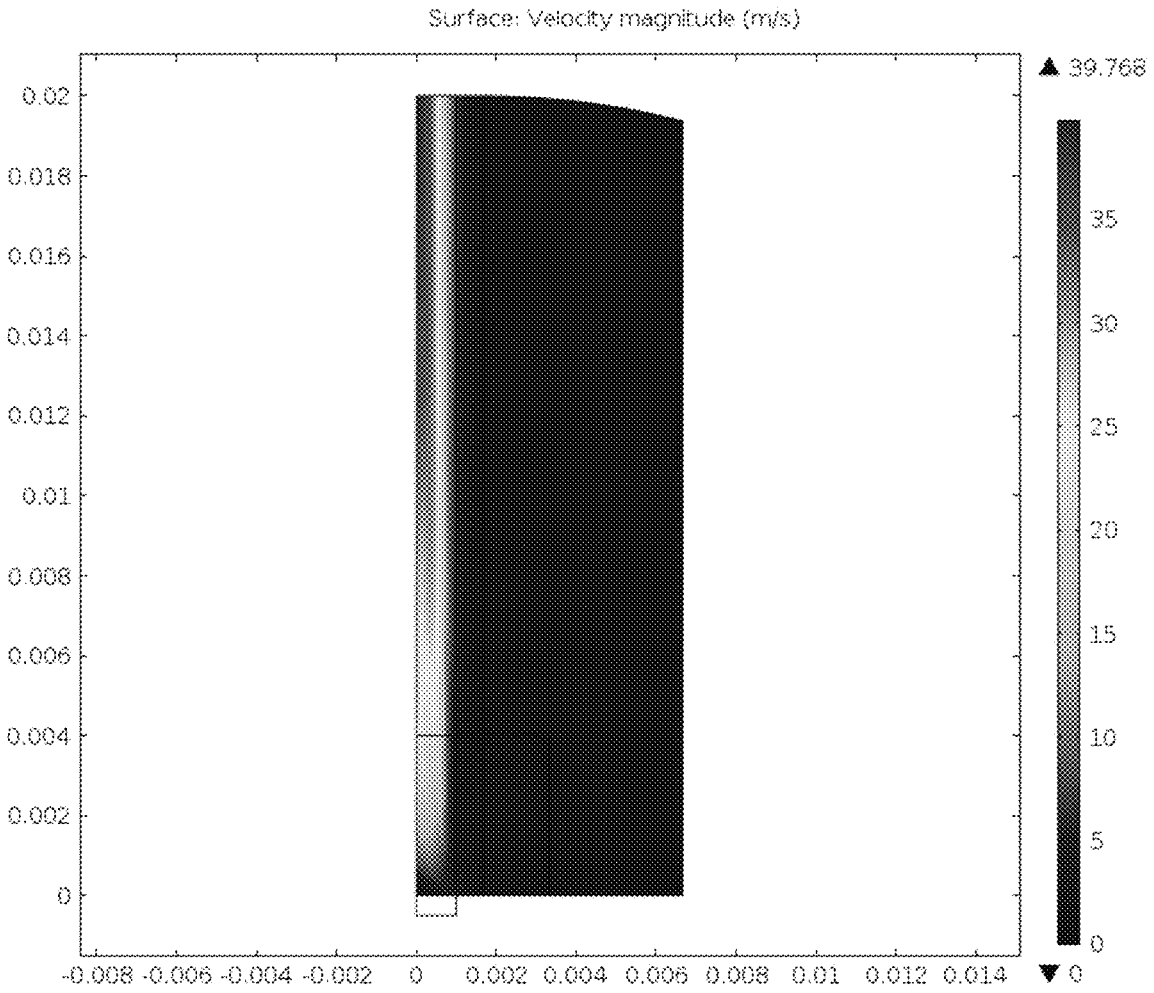

【FIG. 6】
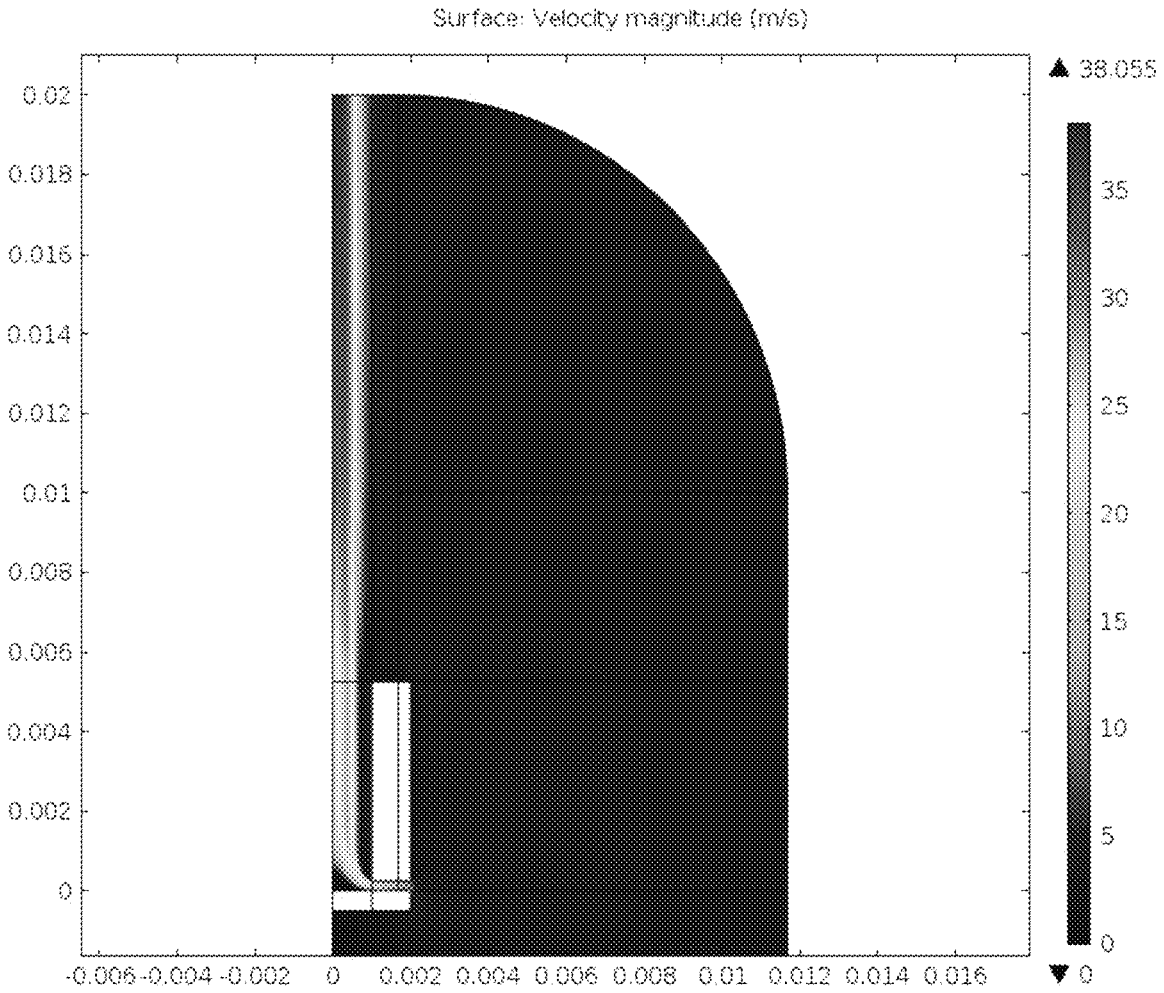

【FIG. 7】
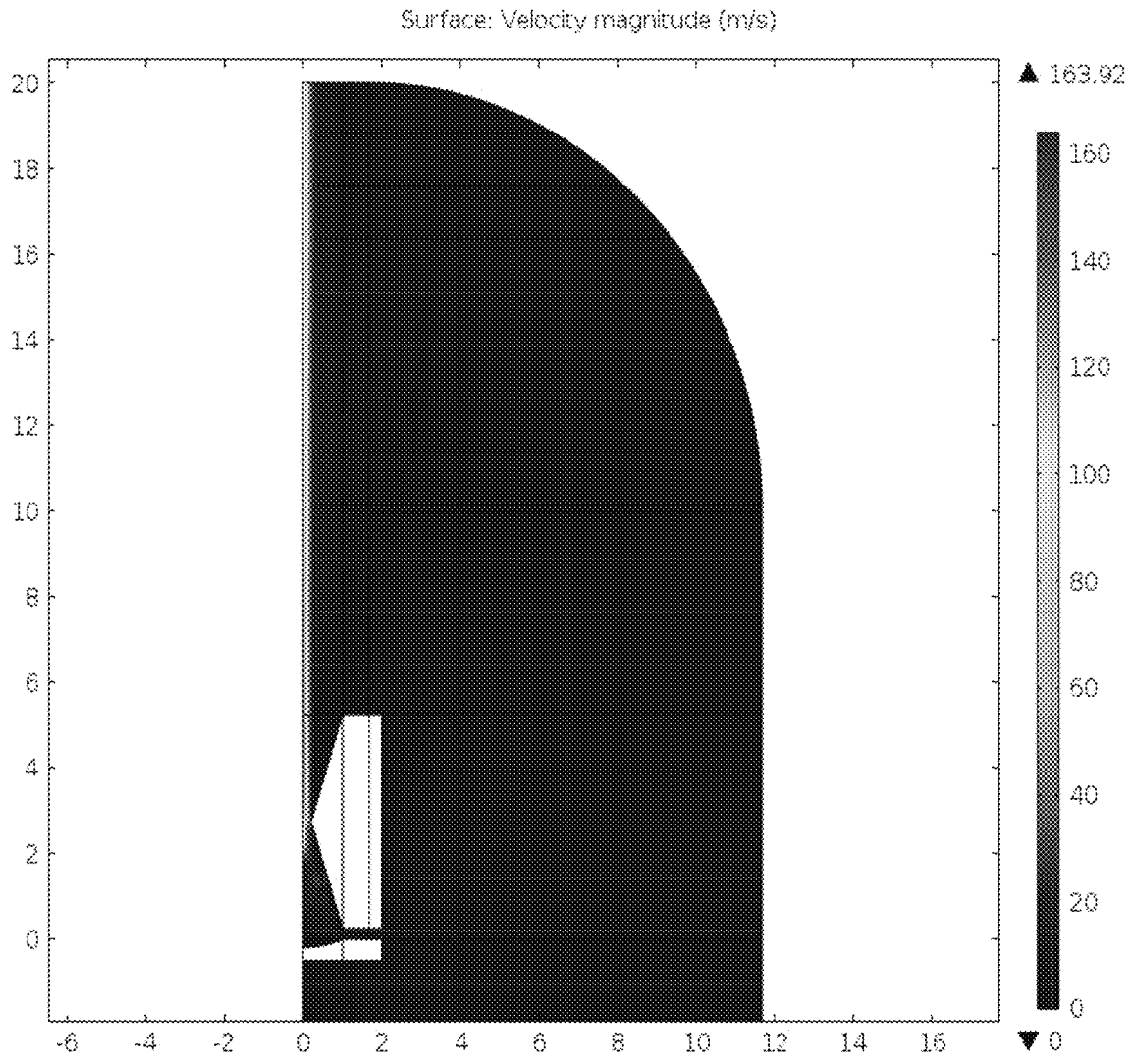

PROPULSION APPARATUS USING SOUND RADIATION FORCE AND CONTROL METHOD THEREFOR

CROSS REFERENCE TO RELATED APPLICATIONS

This application is a National Stage of International Application No. PCT/KR2015/011262 filed Oct. 23, 2015, claiming priority based on Korean Patent Application No. 10-2014-0144477 filed Oct. 23, 2014, the contents of all of which are incorporated herein by reference in their entirety.

TECHNICAL FIELD

Exemplary embodiments of the present invention relate to a propulsion apparatus using sound radiation force which is capable of providing strong propulsive force by using sound radiation force of ultrasound.

BACKGROUND ART

As a method of propelling the existing ultra-small wireless flying object, there are methods using propellers and wings. The method using the propeller rotates the propeller by using a small motor, thereby obtaining thrust in a direction opposite to an air flow generated by the rotation of the propeller. The method using the wing uses a method of mimicking animal's wing flapping. Thrust is obtained by making artificial muscles with various methods and flapping the light wings.

The method using the propeller is efficient, but has a drawback because of use of the motor. The motor includes a coil, a rotating body, and a permanent magnet, and as a result, there is a limitation in size. The size of the motor causes a great limitation in an ultra-small flying object. Therefore, researches are being conducted on an ultra-small flying object having a size less than 5 cm in respect to the method of using the wing. However, this method causes a manufacturing method to be complicated, and it is difficult to implement actual commercialization because it is complicated to operate the wing.

Meanwhile, ultrasound is a type of sound and refers to sound waves with frequencies equal to or higher than 20 kHz which humans cannot hear, and because a human's eardrum cannot keep up with vibration velocity and great power is transmitted by small vibration, and as a result, the ultrasound is used for mechanical processing, cleaning, and the like, and the ultrasound is transmitted to a long distance because of directionality and straightness which are properties of the ultrasound.

In particular, in 2006, it was confirmed that an ultrasound generator generated sound waves with a wavelength (17 kHz) of 20 millimeters by making a sound wave pressure field between the ultrasound generator and a reflection device by using the ultrasound generator and the reflection device, and as a result, various types of live animals came up.

Hypersonic waves refer to sound waves with frequencies per second exceeding 500 MHz, and are used for hypersonic pistols and hypersonic acoustic effects at present, and it has been known that if a person is exposed to intense noise for over several seconds, he/she loses his/her hearing and his/her body is injured.

An exemplary embodiment of the present invention proposes a propulsion apparatus capable of providing strong propulsive force to an object to be operated by using sound radiation force of ultrasound.

DISCLOSURE

Technical Problem

An exemplary embodiment of the present invention proposes a propulsion apparatus capable of providing strong propulsive force to an object to be operated by using sound radiation force of ultrasound, and a control method therefor.

Technical Solution

A propulsion apparatus using sound radiation force according to an exemplary embodiment of the present invention includes: an ultrasound generation unit which is installed at one side of an object to be operated, generates ultrasound, and provides propulsive force to the object to be operated by using sound radiation force of the ultrasound; and an ultrasound control unit which is coupled to one side of the ultrasound generation unit, and increases propulsive force to be provided to the object to be operated by controlling intensity of the ultrasound generated by the ultrasound generation unit.

The ultrasound control unit may control intensity of the ultrasound by adjusting a flow of air flowing in a traveling direction of the ultrasound.

The ultrasound control unit may be a tube having a cross-sectional area of which the radius is constant in a longitudinal direction thereof.

The ultrasound control unit may be a focuser having a cross-sectional area of which the radius is gradually decreased in a longitudinal direction thereof.

The ultrasound generation unit may be installed at an end in a direction opposite to a direction in which the object to be operated travels.

The ultrasound generation unit may be a high-frequency ultrasound element which generates ultrasound with high frequencies equal to or higher than 100 kHz.

The ultrasound generation unit may adjust frequencies for generating the ultrasound in accordance with a traveling velocity of the object to be operated in consideration of ultrasound intensity control by the ultrasound control unit.

A method of controlling a propulsion apparatus using sound radiation force according to another exemplary embodiment of the present invention includes: generating ultrasound and providing propulsive force to an object to be operated by using sound radiation force of the ultrasound, by an ultrasound generation unit installed at one side of the object to be operated; and increasing propulsive force to be provided to the object to be operated by controlling intensity of the ultrasound generated by the ultrasound generation unit, by an ultrasound control unit coupled to one side of the ultrasound generation unit.

The increasing of the propulsive force to be provided to the object to be operated may include controlling intensity of the ultrasound by adjusting a flow of air flowing in a traveling direction of the ultrasound, by a tube having a cross-sectional area of which the radius is constant in a longitudinal direction thereof.

The increasing of the propulsive force to be provided to the object to be operated may include controlling intensity of the ultrasound by adjusting a flow of air flowing in a traveling direction of the ultrasound, by a focuser having a cross-sectional area of which the radius is gradually decreased in a longitudinal direction thereof.

Advantageous Effects

According to the exemplary embodiment of the present invention, it is possible to provide strong propulsive force to an object to be operated by using sound radiation force of ultrasound.

According to the exemplary embodiment of the present invention, it is possible to implement a high-efficiency ultra-small propulsion body that is substituted for the existing propeller-type and wing-type ultra-small propulsion bodies.

DESCRIPTION OF DRAWINGS

The patent or application file contains at least one drawing executed in color. Copies of this patent or patent application publication with color drawings will be provided by the Office upon request and payment of the necessary fee.

FIG. 1 is a view illustrating an overview of a propulsion apparatus for providing propulsive force by using sound radiation force of ultrasound.

FIG. 2 is a block diagram for explaining a propulsion apparatus using sound radiation force according to an exemplary embodiment of the present invention.

FIGS. 3 and 4 are views illustrating another example of the propulsion apparatus using sound radiation force according to the exemplary embodiment of the present invention.

FIGS. 5 to 7 are views illustrating air flows calculated by simulations.

FIG. 8 is a flowchart for explaining a method of controlling the propulsion apparatus using sound radiation force according to the exemplary embodiment of the present invention.

BEST MODE

Advantages and/or features of the present invention and methods of achieving the advantages and features will be clear with reference to exemplary embodiments described in detail below together with the accompanying drawings. However, the present invention is not limited to the exemplary embodiments set forth below, and may be embodied in various other forms. The present exemplary embodiments are for rendering the disclosure of the present invention complete and are set forth to provide a complete understanding of the scope of the invention to a person with ordinary skill in the technical field to which the present invention pertains, and the present invention will only be defined by the scope of the claims. Like reference numerals indicate like constituent elements throughout the specification.

Air is moved by a mechanical method in the related art, but in the exemplary embodiment of the present invention, propulsive force may be obtained by generating an air flow by using an acoustic method. Ultrasound radiates in one direction when a size of a high-frequency ultrasound element (>100 kHz) is very greater than a wavelength. The radiating ultrasound is attenuated in air, and volume force is applied to the air in proportion to the attenuation. The air is pushed by this force, and force is applied to a transducer because of a reaction to the force.

A propulsion apparatus, which provides propulsive force by using the aforementioned principle, will be briefly described with reference to FIG. 1.

FIG. 1 is a view illustrating an overview of the propulsion apparatus for providing propulsive force by using sound radiation force of ultrasound.

Referring to FIG. 1, ultrasound B radiates with directionality when a size of a light and thin ultrasound element A is very greater than a wavelength of the ultrasound. Volume force C is applied to air in a direction of sound in proportion to intensity of the radiating ultrasound, and as a result, the air has a flow indicated by D. Consequently, the ultrasound element A, that is, the ultrasound transducer pushes the air toward one side, and as a result, propulsive force is obtained in a direction opposite to the direction of sound.

Hereinafter, exemplary embodiments of the present invention will be described in detail with reference to the accompanying drawings.

FIG. 2 is a block diagram for explaining the propulsion apparatus using sound radiation force according to the exemplary embodiment of the present invention. Further, FIGS. 3 and 4 are views illustrating another example of the propulsion apparatus using sound radiation force according to the exemplary embodiment of the present invention.

First, referring to FIG. 2, a propulsion apparatus 100 using sound radiation force according to the exemplary embodiment of the present invention may include an ultrasound generation unit 110 and an ultrasound control unit 120.

The ultrasound generation unit 110 is installed at one side of an object 101 to be operated, generates ultrasound, and provides propulsive force to the object 101 to be operated by using sound radiation force of the ultrasound.

Here, the object 101 to be operated may include a small and light carrying body such as an ultra-small unmanned flying object and a micro robot. The ultrasound generation unit 110 installed on the object 101 to be operated is installed at a rear side of the object 101 to be operated, that is, at an end in a direction opposite to a traveling direction, thereby providing propulsive force to the object 101 to be operated.

The ultrasound generation unit 110 may be implemented as a high-frequency ultrasound element that generates ultrasound with high frequencies equal to or higher than 100 kHz.

Because the principle of providing propulsive force to the object 101 to be operated by using sound radiation force of the ultrasound generated by the ultrasound generation unit 110 is identical to the principle described with reference to FIG. 1, a description thereof will be omitted here.

For reference, even a flat plate type propulsion apparatus configured only by the ultrasound generation unit 110 may provide propulsive force to the object 101 to be operated by using sound radiation force of the ultrasound, but in this case, air may flow into left and right sides, and as a result, propulsive force may deteriorate.

Therefore, there is a need for a method that adjusts a flow of the inflow air without hindering the travel of the ultrasound. In the exemplary embodiment of the present invention, the ultrasound control unit 120 is coupled to one side of the ultrasound generation unit 110, such that it is possible to adjust an air flow, and thus to increase the propulsive force.

Hereinafter, the ultrasound control unit 120 will be more specifically described as a configuration for increasing the propulsive force.

The ultrasound control unit 120 is coupled to one side of the ultrasound generation unit 110, and serves to control intensity of the ultrasound generated by the ultrasound generation unit 110, thereby increasing propulsive force to be provided to the object 101 to be operated.

To this end, the ultrasound control unit 120 controls intensity of the ultrasound by adjusting a flow of air flowing in the traveling direction of the ultrasound, thereby increasing propulsive force to be provided to the object 101 to be operated.

As an example, as illustrated in FIG. 3, the ultrasound control unit 120 may be implemented in the form of a tube having a cross-sectional area of which the radius is constant in a longitudinal direction thereof.

In a case in which the ultrasound control unit 120 is implemented in the form of a tube, it is possible to prevent air from flowing into the left and right sides, and thus to adjust a flow of the inflow air without hindering the travel of the ultrasound.

Therefore, it is possible to increase intensity of the ultrasound generated by the ultrasound generation unit 110, and as a result, it is possible to increase propulsive force to be provided to the object 101 to be operated.

As another example, as illustrated in FIG. 4, the ultrasound control unit 120 may be implemented in the form of a focuser having a cross-sectional area of which the radius is gradually decreased in a longitudinal direction thereof.

Similar to the tube as illustrated in FIG. 3, in a case in which the ultrasound control unit 120 is implemented in the form of a focuser, it is possible to prevent air from flowing into the left and right sides, and thus to adjust a flow of the inflow air without hindering the travel of the ultrasound.

Therefore, it is possible to increase intensity of the ultrasound generated by the ultrasound generation unit 110 by increasing an air flow at a central portion (portion having a smallest radius) of the focuser, thereby further increasing propulsive force to be provided to the object 101 to be operated.

Meanwhile, the ultrasound generation unit 110 may adjust frequencies for generating the ultrasound in accordance with a traveling velocity of the object 101 to be operated in consideration of ultrasound intensity control by the ultrasound control unit 120.

That is, the ultrasound generation unit 110 may adjust frequencies for generating the ultrasound in accordance with a traveling velocity of the object 101 to be operated in consideration of a propulsive force increment by the ultrasound control unit 120, thereby controlling a velocity of the object 101 to be operated by the propulsion apparatus 100 as necessary.

FIGS. 5 to 7 are views illustrating air flows calculated by simulations. In particular, FIG. 5 is a view illustrating an air flow at an upper end of the flat plate type propulsion apparatus, that is, a flat plate type ultrasound transducer, FIG. 6 is a view illustrating an air flow in the propulsion apparatus coupled to the tube (tube type propulsion apparatus), and FIG. 7 is a view illustrating an air flow in the propulsion apparatus coupled to the focuser (focuser type propulsion apparatus).

All of the transducers (propulsion apparatuses) applied to FIGS. 5 to 7 are made of silicone and have a circular shape having a radius of 1 mm and a thickness of 0.5 mm. A calculated weight of the element is about 3.7 mg.

First, as illustrated in FIGS. 5 and 6, it can be seen that a difference in changes of maximum velocities of the air is small, but a flow of the inflow air is assuredly increased in the tube type propulsion apparatus in FIG. 6 in comparison with the flat plate type propulsion apparatus in FIG. 5, and as a result, it can be seen that the tube type propulsion apparatus may more efficiently control a flow of the inflow air.

For reference, in the case of the flat plate type ultrasound transducer, air radiates at about 30 m/s or higher in a region of a radius of 0.5 mm, and thrust, which may be obtained by the air flow, is about 0.000867 N which corresponds to a weight of 88.5 mg. Therefore, the present simulation may indicate that the flat plate type ultrasound transducer may produce propulsive force of about 24 times its weight.

Meanwhile, as illustrated in FIG. 7, it can be seen that in the case of the focuser type propulsion apparatus, a very high flow velocity of 160 m/s occurs in a very small region. The focuser type propulsion apparatus may obtain strong propulsive force by using the high flow velocity.

FIG. 8 is a flowchart for explaining a method of controlling the propulsion apparatus using sound radiation force according to the exemplary embodiment of the present invention.

Referring to FIGS. 2 and 8, in step 810, the ultrasound generation unit 110 of the propulsion apparatus 100 generates ultrasound, and provides propulsive force to the object 101 to be operated by using sound radiation force of the ultrasound.

Next, in step 820, the ultrasound control unit 120 of the propulsion apparatus 100 may increase propulsive force to be provided to the object 101 to be operated by controlling intensity of the ultrasound generated by the ultrasound generation unit 110.

That is, the ultrasound control unit 120 of the propulsion apparatus 100 controls intensity of the ultrasound by adjusting a flow of air flowing in the traveling direction of the ultrasound, thereby increasing propulsive force to be provided to the object 101 to be operated.

To this end, the ultrasound control unit 120 of the propulsion apparatus 100 may be implemented in the form of a tube having a cross-sectional area of which the radius is constant in the longitudinal direction thereof (see FIG. 3), or may be implemented in the form of a focuser having a cross-sectional area of which the radius is gradually decreased in the longitudinal direction thereof (see FIG. 4).

While the specific exemplary embodiments according to the present invention have been described above, the exemplary embodiments may be modified to various exemplary embodiments without departing from the scope of the present invention. Therefore, the scope of the present invention should not be limited to the described exemplary embodiments, and should be defined by not only the claims to be described below but also those equivalents to the claims.

The invention claimed is:

1. A propulsion apparatus using sound radiation force, the propulsion apparatus comprising:

an ultrasonic transducer which is installed at one side of an object to be operated, generates ultrasound, and provides propulsive force to the object by using sound radiation force of the ultrasound; and a tube-shaped ultrasound control unit which is coupled to one side of the ultrasonic transducer, and increases propulsive force to be provided to the object by controlling intensity of the ultrasound generated by the ultrasonic transducer, wherein the ultrasonic transducer is configured to adjust a frequency of the ultrasound in accordance with a traveling velocity of the object in consideration of ultrasound intensity control by the tube-shaped ultrasound control unit.

2. The propulsion apparatus of claim 1, wherein the tube-shaped ultrasound control unit controls intensity of the ultrasound by adjusting a flow of air flowing in a traveling direction of the ultrasound.

3. The propulsion apparatus of claim 1, wherein the tube-shaped ultrasound control unit is a tube having a cross-sectional area of which the radius is constant in a longitudinal direction thereof.

4. The propulsion apparatus of claim 1, wherein the tube-shaped ultrasound control unit is a focuser having a cross-sectional area of which the radius is gradually decreased in a longitudinal direction thereof.

5. The propulsion apparatus of claim 1, wherein the ultrasonic transducer is installed at an end in a direction opposite to a direction in which the object travels.

6. The propulsion apparatus of claim 1, wherein the ultrasonic transducer is a high-frequency ultrasound element which generates ultrasound with high frequencies ranging from 100 kHz to 500 MHz.

7. A method of controlling a propulsion apparatus using sound radiation force, the method comprising:

generating ultrasound and providing propulsive force to an object to be operated by using sound radiation force of the ultrasound, by an ultrasonic transducer installed at one side of the object; and increasing propulsive force to be provided to the object by controlling intensity of the ultrasound generated by the ultrasonic transducer, by a tube-shaped ultrasound control unit coupled to one side of the ultrasonic transducer, wherein the ultrasonic transducer adjusts a frequency of the ultrasound in accordance with a traveling velocity of the object in consideration of ultrasound intensity control by the tube-shaped ultrasound control unit.

8. The method of claim 7, wherein the increasing of the propulsive force to be provided to the object includes controlling intensity of the ultrasound by adjusting a flow of air flowing in a traveling direction of the ultrasound, by the tube-shaped ultrasound control unit having a cross-sectional area of which the radius is constant in a longitudinal direction thereof.

9. The method of claim 7, wherein the increasing of the propulsive force to be provided to the object includes controlling intensity of the ultrasound by adjusting a flow of air flowing in a traveling direction of the ultrasound, by the tube-shaped ultrasound control unit having a cross-sectional area of which the radius is gradually decreased in a longitudinal direction thereof.

* * * * *